US005711113A

United States Patent [19]

Nygård

[11] Patent Number: 5,711,113

[45] Date of Patent: Jan. 27, 1998

[54] SUSPENSION MECHANISM FOR A DOOR CONSTRUCTION

[75] Inventor: Jonny Nygård, Heby, Sweden

[73] Assignee: JKG Snickerikonsult AB, Heby, Sweden

[21] Appl. No.: 737,244

[22] PCT Filed: May 19, 1995

[86] PCT No.: PCT/SE95/00568

§ 371 Date: Nov. 14, 1996

§ 102(e) Date: Nov. 14, 1996

[87] PCT Pub. No.: WO95/32351

PCT Pub. Date: Nov. 30, 1995

[30] Foreign Application Priority Data

May 25, 1994 [SE] Sweden ..... 9401797

[51] Int. Cl.[6] ..... E05D 15/46

[52] U.S. Cl. ..... 49/206; 49/205

[58] Field of Search ..... 49/206, 205, 197, 49/203, 204, 299, 200

[56] References Cited

U.S. PATENT DOCUMENTS

| | | | |
|---|---|---|---|
| 2,244,182 | 6/1941 | Allen | 49/205 |
| 3,849,937 | 11/1974 | Blumenthal | 49/206 |
| 3,913,266 | 10/1975 | Smith | 49/197 |
| 5,027,554 | 7/1991 | Parker | 49/206 |
| 5,384,975 | 1/1995 | Yuran | 49/203 |

FOREIGN PATENT DOCUMENTS

| | | | |
|---|---|---|---|
| 218224 | 11/1961 | Austria | 49/205 |
| 913870 | 7/1949 | Germany | 49/206 |
| 1139052 | 10/1962 | Germany | 49/205 |
| 1247899 | 8/1967 | Germany | 49/205 |
| 1261012 | 2/1968 | Germany | 49/206 |
| 2262646 | 7/1973 | Germany | 49/206 |
| 2352499 | 2/1975 | Germany | 49/205 |
| 2513837 | 10/1976 | Germany | 49/206 |
| 2618050 | 11/1976 | Germany | 49/206 |
| 2721140 | 11/1978 | Germany | 49/206 |
| 3014414 | 11/1981 | Germany | 49/206 |
| 3026612 | 1/1982 | Germany | 49/206 |
| 129 923 | 6/1974 | Norway . | |
| 202477 | 3/1966 | Sweden | 49/206 |
| 462 054 | 4/1990 | Sweden . | |

*Primary Examiner*—Kenneth J. Dorner
*Assistant Examiner*—Curtis Cohen
*Attorney, Agent, or Firm*—Jacobson, Price, Holman & Stern, PLLC

[57] ABSTRACT

A suspension mechanism for pivotally moving a door panel to close or open a doorway includes a first brace with one end attached to a point low on the panel and the opposite end to a stationary pivot and a second brace with one end attached to the first brace intermediate of its ends and the opposite end slidably and rotatably connected near the top of the panel for support thereof. A stationary but rotatable axial guide receives the second brace intermediate of its ends, and a torque generating spring assists with lifting and opening the panel with energy stored from the lowering of the panel. The spring may be a compression spring encircling the second brace with one end attached near the upper end of the second brace and the opposite end attached to the stationary axial guide, thus locating the spring near the top of the doorway. Alternatively, the spring may be a tension spring having one end attached to the first brace on an extension from the stationary pivot and the opposite end attached to the door frame below the stationary pivot.

12 Claims, 1 Drawing Sheet

SUSPENSION MECHANISM FOR A DOOR CONSTRUCTION

The present invention relates to a suspension mechanism for a door construction of the kind which includes a door panel that can be swung vertically up and down, wherein the door construction includes a stationary pivot means located in the region between the upper and lower parts of the door opening, a first brace means extending from the pivot means to the lower part of the door, a spring means which is tensioned when closing the door and which when opening the door exerts a torque-generating force that tends to pivot the first brace such as to raise the door panel, and further includes a second brace means whose one end is pivotally connected to the first brace by a second pivot means at a point between the stationary first pivot means and the point of connection of the first brace to the lower part of the door, wherein the other end of the second brace is intended to support against the upper part of the door panel.

Figure 1:
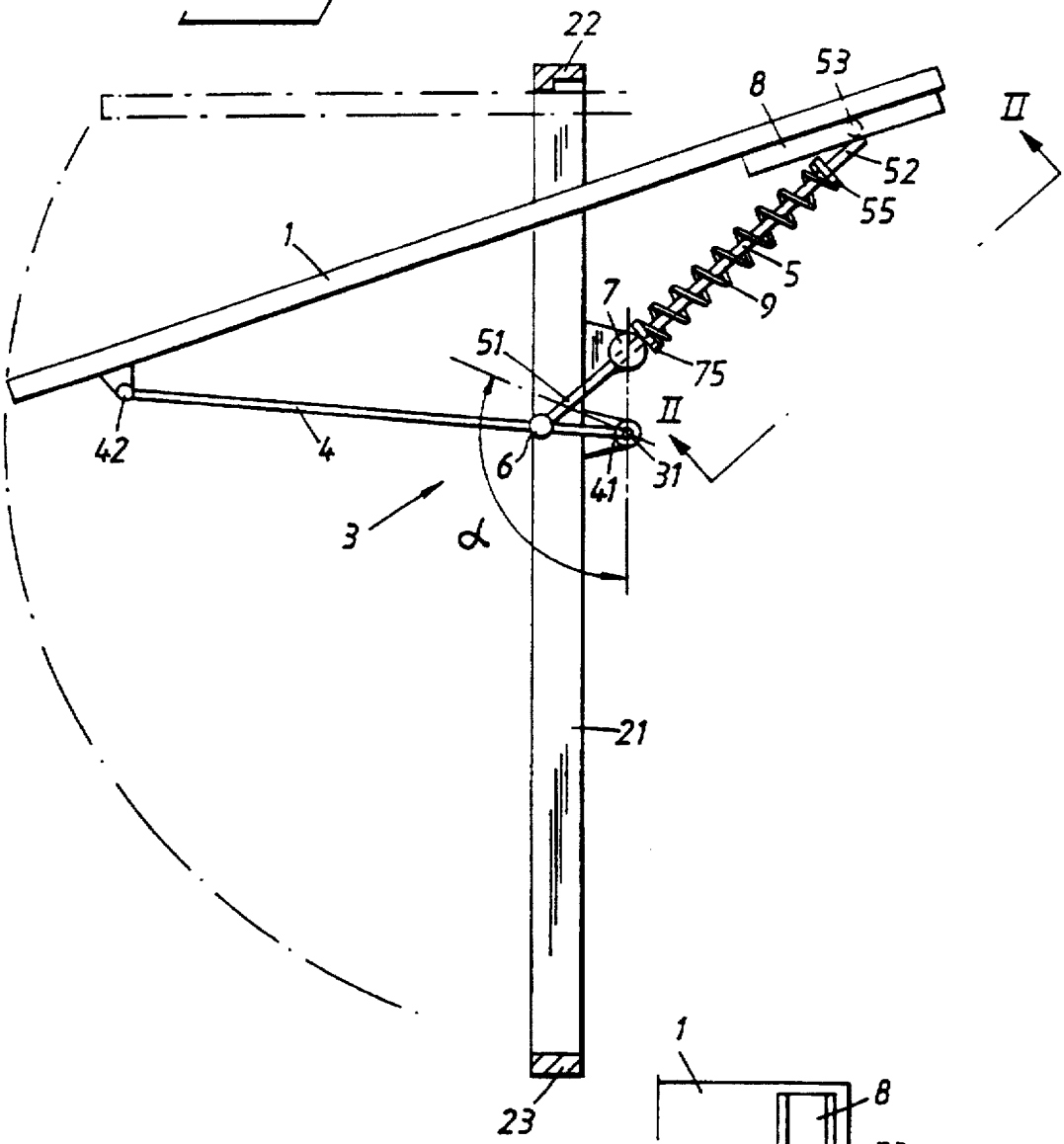

An arrangement of this kind is known from FIG. 1 of SE-B-462 054 for instance.

It is preferred to use compression springs in arrangements of this kind. The lifting force of a compression spring will be limited only to a relatively small degree should the spring fracture. In contrast, the lifting function of a pull spring or tension spring is lost completely when such a spring fractures.

One problem with compression springs, and then particularly with compression springs that are located in the region of the lower half of the door, is that the turns of the spring are mutually compressed as the door is closed. This presents a danger to children playing in the vicinity of an exposed spring.

Consequently, it has been considered necessary to encase the compression spring in a protective sleeve and to extend a pull rod through the full length of the spring, wherein the sleeve also functions to transmit the forces that pass through the spring.

The object of the invention is to provide a simple door suspension mechanism of the kind defined in the introduction, partly with the aim of simplifying the actual linkage mechanism itself, and partly with the aim of also simplifying the spring arrangement while minimizing the risk of damage thereto.

The invention is defined in the following claim 1.

Embodiments of the inventive arrangement are defined in the claims appendant to claim 1.

In a construction of the kind described in the introduction, the invention is characterized in that the second brace means extends displaceably through a stationary axial guide means located above the first stationary pivot means.

This axial guide enables the second brace to move axially through the guide and also to pivot therein. This pivoting action of the second brace can be achieved, for instance, by mounting the guide for rotation on a horizontal axle which extends at right angles to the second brace. The actual axial guide can then consist in an opening in the rotatable part of the guide, said opening corresponding in shape to the cross-sectional shape of the second brace.

The stationary pivot means and the stationary axial guide may advantageously be located close to the plane of the door panel when the door is closed, wherein the links may extend parallel with and close to the plane of the door panel when the door is closed. The spring means may include a compression spring and the spring may surround the second brace between the axial guide and that end of the second brace which supports against the door. The second brace will therewith also function to stabilize the compression spring, so as to prevent the spring from buckling away from its operative direction.

According to one embodiment of the invention, that end of the second brace which supports against the door may have the form of a runner and the door may have fitted thereto an undercut profiled section which extends vertically along the door panel and which receives said brace end in a shape bound manner for movement of said brace end along the profiled section. As an alternative to the aforedescribed positioning of the compression spring it is conceivable to allow the spring to act along the profiled section, or rail, towards the end of the second brace that supports against the door.

This will enable the compression spring to be placed on the door at a higher level, therewith reducing the risk of children playing in the vicinity from being pinched by the spring, and it is also conceivable in this case to refrain from encasing the spring in a protecting sleeve or like device.

It will be observed that the invention is effective with the use of only two braces, of which one also functions as a stabilizing rod for preventing buckling of a compression spring in accordance with the preferred embodiment of the invention.

It will also be observed that the arrangement requires no guide rails for the upper edge of the door panel, and it will be seen that the upper edge of the door panel follows a path which lies close to the horizontal plane through the upper edge of the door opening, as the door is closed and opened.

This enables the upper edge of the door opening to be placed close to the ceiling of the room onto which the door arrangement adjoins.

Naturally, if desired, a pull spring or draw spring can be used instead of a compression spring, in which case the spring can be fitted in manner such that as the door is opened the spring will exert on the first brace a torque which strives to raise the door panel. The spring means used in the inventive arrangement are arranged conventionally so as to be tensioned when the door is closed and relaxed when the door is opened.

Figure 2:
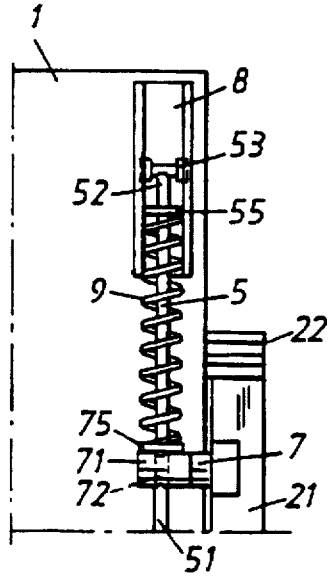

The invention will now be described with reference to exemplifying embodiments thereof and also with reference to the accompanying drawing, in which FIG. 1 is a schematic vertical sectional view of a door construction which includes an inventive arrangement; and FIG. 2 is a schematic view taken on the line II—II in FIG. 1.

FIG. 1 illustrates a door construction which includes a door panel or door 1 and an associate door frame comprising frame side members 21, a frame head 22 and a frame sill 233. The door 1 is suspended on each side by a suspension mechanism 3. The mechanism includes a stationary pivot bearing 31 whose pivot axle is horizontal and parallel with the plane of the door opening. The pivot bearing 31 pivotally journals one end 41 of a first brace means 4 whose other end 42 is pivotally connected to the lower part of the door 1. One end 51 of a second brace means 5 is connected by pivot means 6 to the first link 4, between its ends 41, 42. The second brace 5 extends through a stationary axial guide 7, which may be attached to one frame side member 21. The axial guide 7 has a part 71 which includes a through passing bore 72 which enables axial movement of the brace 5 through the part 71. The guide part 7 can be rotated about an axle which is parallel with the plane of the door opening. The other end 52 of the brace 5 supports against the upper part of the door 1, preferably through the medium of a runner 53. The runner may be arranged to run in a guide rail 8 which is undercut so as to hold the runner 53 in contact with the door 1 as the runner moves. The axial guide 7 carries a support plate 75 through which the brace 5 can be moved axially. A support plate 55 is fitted to the upper end of the brace 5. A compression spring 9 supports against the two plates 75, 55, said spring preferably being a helical spring which surrounds the brace 5.

It will be seen from FIG. 1 that the pivot means 6 is able to move through an angle α, from an upper position, in which the door 1 is horizontal and located adjacent the upper edge of the door opening, to a lower position, in which the pivot means 6 lies vertically beneath the pivot bearing 31. The axial guide 7 is located vertically above the pivot bearing 31, so that when the door is closed the braces 4 and 5 will be essentially in axial alignment with one another and generally parallel with the plane of the door opening. Although not clearly shown in the drawing, the brace 4 may carry a support, for instance in the vicinity of the pivot means 6, for supporting against the door 1 when the door is closed.

As shown in FIG. 1, the compression spring 9 is located in an upper part of the door, therewith reducing the risk of children playing near the door being pinched between the turns of the spring 1 as the door closes.

It will also be seen that the sleeve 5 will also function to prevent buckling of the compression spring 9.

One of normal skill in this art with understand that the compression spring 9 can be replaced with another compression spring, for instance a spring which acts along the guide rail 8 towards the outer extremity 52 of the brace 5. The skilled person will also understand that pull springs or draw springs can be used instead of the preferred compression springs. When a pull spring is used, the spring may be mounted against an extension of the brace 4, to the right beyond the pivot means 31 in FIG. 1, wherein the other end of the pull spring can be connected to a stationary point, for example to one frame side member 21, in a plane which is perpendicular to the plane of the door opening and which includes both pull spring suspension points.

As shown in FIG. 1, the frame head member 22 has a rebate which forms an abutment surface for the upper edge of the door 1.

It follows from the aforedescribed door geometry that the center of gravity of the door i will be located to the right of the support point 42 in the FIG. 1 illustration, and hence the door I will rest on the outer supportive end of the brace 5 when the door 1 is lowered from the vertical plane. It is possible for the upper end of the door panel 1 to be moveable away from supportive end 52 of the brace 5 at small opening angle of the door panel 1, although on the other hand the frame head 22 forms a stop which prevents the door 1 from swinging away from the supportive end 52 of the brace 5 around the pivot means 42.

It will be seen from FIG. 1 and 2 that the inventive invention can be given a small construction height from the inside of the door 1 (the right side in FIG. 1), namely a construction height which is defined essentially by the distance of the members 7, 31 from the right side of the frame 2 in FIG. 1.

If desired, a support flange can be fitted to the door 1, along the guide rail 8, or along the frame side member 21 shown in FIG. 1, this flange forming a spacer means which protects the more sensitive components of the arrangement, for instance when complete door constructions which include the inventive arrangement are stacked for transportation or for some other reason. The support flange may be formed as part of the runner guide rail 8.

I claim:

1. A suspension mechanism for a door construction of the kind which includes a door panel that can be swung vertically up and down, wherein the suspension mechanism includes a stationary pivot means (31) located in the region between a upper and lower parts of the door opening, a first brace means (4) extending from the pivot means (31) to the lower part of the door, a spring means (9) which stores energy when closing the door (1) and which when opening the door exerts a torque-generating force which causes the first brace means (4) to pivot and therewith raise the door panel, and further includes a second brace means (5) whose one end (51) is pivotally connected to the first brace means (4) by a second pivot means (6) at a point between the stationary first pivot means (31) and the point of connection of the first brace means (4) to the lower part of the door, wherein the other end (52) of the second brace means (5) is intended to support against the upper part of the door panel (1), characterized in that the second brace means (5) extends in and is axially moveable through a stationary axial guide (7) located above the first pivot means (31).

2. A suspension mechanism according to claim 1, characterized in that the pivot means (31), the axial guide (7) and the brace means (4, 5) are adapted to bring the door panel essentially into contact with the upper edge of a port opening when the door panel has been swung to a generally horizontal position and preferably lies centered in relation to a plane of the port opening.

3. A suspension mechanism according to claim 1, characterized in that said other end of the second brace means is arranged to run along the door panel (1) and carries a runner (53), such as a roller.

4. A suspension mechanism according to claim 1, characterized in that the door panel includes a rail (8) which receives the upper end (52, 53) of the second brace means (5).

5. A suspension mechanism according to claim 4, characterized in that the rail (8) is undercut, to hold the runner (53) in place.

6. A suspension mechanism according to claim 1, characterized in that the spring means is a compression spring (9).

7. A suspension mechanism according to claim 6, characterized in that the compression spring (9) acts between the upper endpart (52) of the second brace means (5) and the stationary axial guide (7).

8. A suspension mechanism according to claim 7, characterized in that the compression spring surrounds the second brace means (5).

9. A suspension mechanism according to claim 6, characterized in that the compression spring acts towards the upper end of the second brace means (5) and exerts a force along the door panel in the direction of said panel.

10. A suspension mechanism according to claim 1, characterized in that the door construction includes a frame which defines the door opening; and in that a stationary first pivot means (31) and the axial guide (7) are attached to a frame side member (21).

11. A suspension mechanism according to claim 1, characterized in that the stationary pivot means (31) and the stationary axial guide (7) are located close to the plane of the door opening; and in that the first and second brace means (4, 5) extend generally parallel with the plane of the door opening when the door is closed.

12. A suspension mechanism according to any one of claims 1–11, characterized in that a suspension mechanism is provided on each side of the door panel (1), said two mechanisms being mutually identical.

* * * * *